US010407208B2

(12) United States Patent
Mitten et al.

(10) Patent No.: US 10,407,208 B2
(45) Date of Patent: Sep. 10, 2019

(54) RE-CLOSEABLE TEAR OPEN PACK, A BLANK FOR FORMING THE PACK, AND A METHOD OF MAKING THE PACK

(71) Applicant: Altria Client Services LLC, Richmond, VA (US)

(72) Inventors: Robert T. Mitten, Glen Allen, VA (US); Scott A. Fath, Richmond, VA (US); William J. Bogdziewicz, Richmond, VA (US); Benjamin Ivry, Richmond, VA (US); Aaron Ovadia, Beit Shemesh (IL); Gavriel Zeitlin, Beit Shemesh (IL)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 147 days.

(21) Appl. No.: 15/196,406

(22) Filed: Jun. 29, 2016

(65) Prior Publication Data

US 2018/0002061 A1 Jan. 4, 2018

(51) Int. Cl.
*B65D 5/00* (2006.01)
*B65D 5/02* (2006.01)
(Continued)

(52) U.S. Cl.
CPC ..... *B65D 5/542* (2013.01); *B31B 50/60* (2017.08); *B65D 5/0254* (2013.01);
(Continued)

(58) Field of Classification Search
CPC ..... B65D 5/54; B65D 85/10; B65D 77/30
(Continued)

(56) References Cited

U.S. PATENT DOCUMENTS

D35,615 S 1/1902 Stecher
1,009,804 A 11/1911 Sugarman
(Continued)

FOREIGN PATENT DOCUMENTS

EP 0615913 A1 9/1994
EP 1588633 A1 10/2005
(Continued)

OTHER PUBLICATIONS

Office Action dated Feb. 28, 2017 in related U.S. Appl. No. 29/569,608.

(Continued)

*Primary Examiner* — Brian D Nash
(74) *Attorney, Agent, or Firm* — Harness, Dickey & Pierce, P.L.C.

(57) ABSTRACT

The pack includes a box structure defining an inner cavity. A side of the box structure is sealed by a first adhesive. A lower end of the pack is sealed by a second adhesive connecting a rear surface of a lower panel of a front panel to a front surface of a lower glue panel of a back panel. The upper portion of the pack is circumscribed by perforated lines that cause the upper portion to remain connected to the tuck panel if the upper end of the pack is opened. The blank for forming the pack includes an upper portion of a back panel that is circumscribed by perforated lines. The method of making the pack includes applying an adhesive to the upper portion of the back panel and connecting a rear surface of a tuck panel to the upper portion.

15 Claims, 10 Drawing Sheets

(51) Int. Cl.

| | |
|---|---|
| ***B65D 5/54*** | (2006.01) |
| ***B65D 77/02*** | (2006.01) |
| ***B65D 5/66*** | (2006.01) |
| ***B31B 50/60*** | (2017.01) |
| *B31B 50/26* | (2017.01) |
| *B31B 100/00* | (2017.01) |
| *B31B 50/62* | (2017.01) |
| *B31B 110/35* | (2017.01) |

(52) U.S. Cl.
CPC ..... *B65D 5/6602* (2013.01); *B65D 77/02* (2013.01); *B31B 50/26* (2017.08); *B31B 50/624* (2017.08); *B31B 2100/00* (2017.08); *B31B 2110/35* (2017.08)

(58) Field of Classification Search
USPC ..... 229/223, 160.1
See application file for complete search history.

(56) References Cited

U.S. PATENT DOCUMENTS

| | | | | |
|---|---|---|---|---|
| D94,062 | S | 12/1934 | Wilsdon | |
| 3,037,684 | A | 6/1962 | Andrews et al. | |
| D214,879 | S | 8/1969 | Roccaforte et al. | |
| D218,677 | S | 9/1970 | Biallo | |
| D219,266 | S | 11/1970 | Biallo | |
| D221,626 | S | 8/1971 | Fine | |
| 3,861,583 | A | 1/1975 | Tingley et al. | |
| D234,252 | S | 2/1975 | Gerson | |
| 4,062,486 | A | 12/1977 | Goodrich | |
| D250,748 | S | 1/1979 | Leger | |
| 4,614,297 | A * | 9/1986 | Davis | B65D 5/0227 206/807 |
| 4,679,693 | A | 7/1987 | Forman | |
| 4,773,542 | A | 9/1988 | Schillinger et al. | |
| D303,722 | S | 9/1989 | Marlow et al. | |
| 4,917,288 | A | 4/1990 | Heitele et al. | |
| 4,949,841 | A * | 8/1990 | Focke | B65D 85/1009 206/254 |
| 5,014,855 | A | 5/1991 | Roccaforte | |
| 5,018,625 | A | 5/1991 | Focke et al. | |
| 5,123,589 | A | 6/1992 | Cote | |
| 5,184,725 | A | 2/1993 | Reinheimer et al. | |
| 5,190,155 | A | 3/1993 | Grunwald | |
| 5,325,963 | A | 7/1994 | Focke et al. | |
| 5,358,171 | A * | 10/1994 | Focke | B65D 75/5833 206/264 |
| 5,462,223 | A * | 10/1995 | Focke | B05C 5/0212 229/160.1 |
| D365,023 | S | 12/1995 | Abrams et al. | |
| 5,511,722 | A | 4/1996 | Dixon | |
| D387,976 | S | 12/1997 | Mori | |
| 5,975,415 | A | 11/1999 | Zehnal | |
| D434,319 | S | 11/2000 | Mori | |
| D434,652 | S | 12/2000 | Mori | |
| D441,497 | S | 5/2001 | Focke et al. | |
| 6,279,819 | B1 * | 8/2001 | Schultz | B65D 5/4208 206/806 |
| D448,888 | S | 10/2001 | Focke et al. | |
| 6,334,532 | B1 | 1/2002 | Tambo et al. | |
| D465,416 | S | 11/2002 | Dzwill et al. | |
| 6,604,676 | B2 * | 8/2003 | Giblin | B65D 5/543 229/122.32 |
| D484,046 | S | 12/2003 | Kopecky | |
| D487,532 | S | 3/2004 | Draghetti et al. | |
| D503,087 | S | 3/2005 | Dzwill et al. | |
| D531,498 | S | 11/2006 | Fluegel et al. | |
| 7,178,712 | B2 | 2/2007 | Schultz et al. | |
| D545,188 | S | 6/2007 | Billig et al. | |
| D553,494 | S | 10/2007 | Dehlin | |
| 7,353,940 | B2 * | 4/2008 | Sendo | B65D 85/1036 206/268 |
| D579,325 | S | 10/2008 | Bray et al. | |
| D594,323 | S | 6/2009 | Friedman et al. | |
| D594,596 | S | 6/2009 | Mitten et al. | |
| D601,747 | S | 10/2009 | Tabrah | |
| D601,748 | S | 10/2009 | Pipes et al. | |
| D607,318 | S | 1/2010 | Collins | |
| D610,303 | S | 2/2010 | Valle et al. | |
| D616,146 | S | 5/2010 | Holford | |
| 7,717,260 | B2 | 5/2010 | Buse | |
| 7,717,319 | B2 | 5/2010 | Adam | |
| 7,731,024 | B2 * | 6/2010 | Bouno | A24F 15/12 206/268 |
| D619,454 | S | 7/2010 | Fluegel et al. | |
| D624,401 | S | 9/2010 | Friedman et al. | |
| D644,100 | S | 8/2011 | Stacy-Ryan | |
| 8,016,105 | B2 * | 9/2011 | Sendo | B65D 85/1045 206/264 |
| 8,061,586 | B2 | 11/2011 | Fluegel et al. | |
| D654,358 | S | 2/2012 | Ampadu et al. | |
| 8,123,030 | B2 * | 2/2012 | Hein | B65B 19/20 206/273 |
| D655,153 | S | 3/2012 | Mitten et al. | |
| D675,917 | S | 2/2013 | Holford | |
| 8,393,469 | B2 | 3/2013 | Aldridge et al. | |
| 8,875,878 | B2 | 11/2014 | Young | |
| 9,004,273 | B2 * | 4/2015 | Tanbo | B65D 5/5425 206/268 |
| D746,673 | S | 1/2016 | Sanfilippo et al. | |
| D789,782 | S | 6/2017 | Kahawaiolaa et al. | |
| D801,803 | S | 11/2017 | Mitten et al. | |
| D816,507 | S | 5/2018 | Xie et al. | |
| D821,866 | S | 7/2018 | Scotti | |
| D829,092 | S | 9/2018 | Bandiera | |
| D834,409 | S | 11/2018 | Banacki | |
| 2007/0228130 | A1 | 10/2007 | Arai | |
| 2008/0152264 | A1 | 6/2008 | Pokusa et al. | |
| 2010/0170941 | A1 | 7/2010 | Mitra-Shah et al. | |
| 2011/0233106 | A1 | 9/2011 | Fluegel et al. | |
| 2012/0111746 | A1 | 5/2012 | Tanbo et al. | |
| 2012/0199640 | A1 | 8/2012 | Thorne et al. | |
| 2012/0291401 | A1 | 11/2012 | Mitten et al. | |
| 2013/0319886 | A1 | 12/2013 | Ledermann | |
| 2014/0311930 | A1 | 10/2014 | Buse et al. | |
| 2016/0229620 | A1 | 8/2016 | Steinkamp et al. | |
| 2016/0368645 | A1 | 12/2016 | Buse | |
| 2017/0088341 | A1 | 3/2017 | Fallon et al. | |
| 2017/0197778 | A1 | 7/2017 | Slooff | |
| 2017/0283150 | A1 | 10/2017 | Petrucci et al. | |
| 2018/0362247 | A1 | 12/2018 | Slooff | |
| 2018/0370716 | A1 | 12/2018 | Draghetti et al. | |
| 2019/0002187 | A1 | 1/2019 | Kahawaiolaa et al. | |
| 2019/0002188 | A1 | 1/2019 | Rudolf et al. | |
| 2019/0002190 | A1 | 1/2019 | Cailleaux | |

FOREIGN PATENT DOCUMENTS

| | | | |
|---|---|---|---|
| EP | 1739021 | A1 | 1/2007 |
| WO | WO-2012048671 | A2 | 4/2012 |

OTHER PUBLICATIONS

International Search Report and written opinion for PCT/EP2017/066218 dated Sep. 4, 2017.

Notice of Allowance issued Jan. 24, 2019 in related U.S. Appl. No. 29/625,136.

* cited by examiner

RE-CLOSEABLE TEAR OPEN PACK, A BLANK FOR FORMING THE PACK, AND A METHOD OF MAKING THE PACK

BACKGROUND OF THE INVENTION

Field of the Invention

Example embodiments relate generally to a pack. The pack may be re-closeable, and may have a tear open feature to provide tamper resistance.

Related Art

A pack may he used to store and vend consumable items. The pack may, for instance, contain perishable or semi-perishable products that may benefit from protection against an exposure to oxygen, light, and other environmental factors.

SUMMARY OF THE INVENTION

At least one example embodiment relates to a pack.

In one example embodiment, the pack may include a box structure defining an inner cavity, the box structure including, a front panel and a back panel, a first side formed by an intermediate panel that is connected to the front panel and the back panel, a second side that is sealed by a first adhesive, the first adhesive connecting a rear surface of a side panel of the front panel to a front surface of a side glue panel of the back panel, a lower end that is sealed by a second adhesive, the second adhesive connecting a rear surface of a lower panel of the front panel to a front surface of a lower glue panel of the back panel, and an upper end that is sealed by a third adhesive, the third adhesive connecting a rear surface of a tuck panel of the front panel to a front surface of an upper portion of the back panel, the upper portion being circumscribed by a perforated line that is configured to cause the upper portion to stay connected to the tuck panel and tear away from the back panel if the upper end of the box structure is opened.

In one example embodiment, the back panel defines a slit between the upper end and the lower end of the box structure, the slit being positioned to retain a distal end of the tuck panel in order to re-close the upper end of the box structure after the upper end of the box structure has been opened.

In one example embodiment, outer edges of the upper portion are configured to mate with edges of the back panel, along an interface between the upper portion and the back panel that is defined by the perforated line, in order to stabilize a position of the tuck panel on the back panel as the distal end of the tuck panel is retained by the slit in order to reclose the upper end of the box structure after the upper end of the box structure has been opened.

In one example embodiment, the box structure is made from a blank, the blank being a single web of material including, a top panel connected to a top portion of the front panel along a first fold line, the tuck panel connected to a top portion of the top panel along a second fold line, the side panel connected to a first side of the front panel along a third fold line, the lower panel connected to a lower portion of the front panel along a fourth fold line, the intermediate panel connected to a second side of the front panel along a fifth fold line, the intermediate panel connected to a first side of the back panel along a sixth fold line, the side glue panel connected to a second side of the back panel along a seventh fold line, and the lower glue panel connected to a lower portion of the back panel along an eighth fold line.

In one example embodiment, a rear surface of the blank, and at least a portion of the front surface of the upper portion of the back panel, the front surface of the side glue panel, and the front surface of the lower glue panel are vanish free areas.

In one example embodiment, the inner cavity of the pack contains one or more pouches of consumable material, the pack having a length of about 90 mm, a width of about 55 mm and a depth of between about 14 mm and 20 mm.

In one example embodiment, at least one of the first adhesive, the second adhesive and the third adhesive is a pressure sensitive tape.

At least one example embodiment relates to a. blank for forming a pack.

In one example embodiment, the blank includes a single web of material including, a front panel connected to a back panel via an intermediate panel, a top panel connected to a top portion of the front panel along a first fold line, a tuck panel connected to a top portion of the top panel along a second fold line, a side panel connected to a first side of the front panel along a third fold line, a lower panel connected to a lower portion of the front panel along a fourth fold line, the intermediate panel connected to a second side of the front panel along a fifth fold line, the intermediate panel connected to a first side of the back panel along a sixth fold line, a side glue panel connected to a second side of the back panel along a seventh fold line, a lower glue panel connected to a lower portion of the back panel along an eighth fold line, and an upper portion of the back panel being circumscribed by a perforated line.

In one example embodiment, the upper portion of the back panel is configured to tear away from the back panel if a rear surface of the tuck panel is connected to a front surface of the upper portion by a first adhesive and the tuck panel is then subsequently separated from the back panel.

In one example embodiment, a rear surface of the blank, and at least a portion of a front surface of the upper portion of the back panel, a front surface of the side glue panel, and a front surface of the lower glue panel are vanish free areas.

In one example embodiment, an overall width of the blank is between about 150 mm and 162 mm, an overall height of the blank is about 162.5 mm and 174.5 mm, a width of the front and back panels is about 55 mm, a height of the front and back panel is about 90 mm, and a width of the intermediate panel is between about 14 mm and 20 mm.

In one example embodiment, ends of the side glue panel include angled edges that are angled at about 10 degrees relative to the first and eighth fold lines, respectively, and ends of the lower glue panel include angled edges that are angled at about 5 degrees relative to the sixth and seventh fold lines, respectively.

At least one example embodiment relates to a pack made from a blank.

In one example embodiment, the pack includes a box structure defining an inner cavity, wherein sides of the box structure are defined by, the front panel, the back panel, a first side formed by the intermediate panel, a second side formed via a second adhesive connecting a rear surface of the side panel of the front panel to a front surface of the side glue panel of the back panel, a lower side formed via a third adhesive connecting a rear surface of the lower panel of the front panel to a front surface of the lower glue panel of the back panel, and an upper side formed via a fourth adhesive connecting a rear surface of the tuck panel of the front panel to a front surface of the upper portion of the back panel, the upper portion being circumscribed by a perforated line that is configured to cause the upper portion to stay connected to the tuck panel and tear away from the back panel if the upper end of the box structure is opened.

In one example embodiment, the inner cavity of the pack contains one or more pouches of consumable material, the pack having a length of about 90 mm, a width of about 55 mm and a depth of between about 14 mm and 20 mm.

In one example embodiment, at least one of the second adhesive, the third adhesive and the fourth adhesive is a pressure sensitive tape.

At least one example embodiment relates to a method of forming a pack, which includes forming a blank; folding the blank along the fifth and the sixth fold lines so that a rear surface of the front panel faces a rear surface of the back panel; applying a first adhesive to a front surface of the side glue panel and a second adhesive to a front surface of the lower glue panel; folding the blank along the third and the seventh fold lines and connecting a rear surface of the side panel of the front panel to the front surface of the side glue panel using the first adhesive; folding he blank along the fourth and eighth fold lines and connecting a rear surface of the lower panel of the front panel to the front surface of the lower glue panel using the second adhesive; applying a third adhesive to a front surface of the upper portion of the back panel; and folding the blank along the first and second fold lines and connecting a rear surface of the tuck panel to the front surface of the upper portion using the third adhesive.

DETAILED DESCRIPTION

Figure 1:
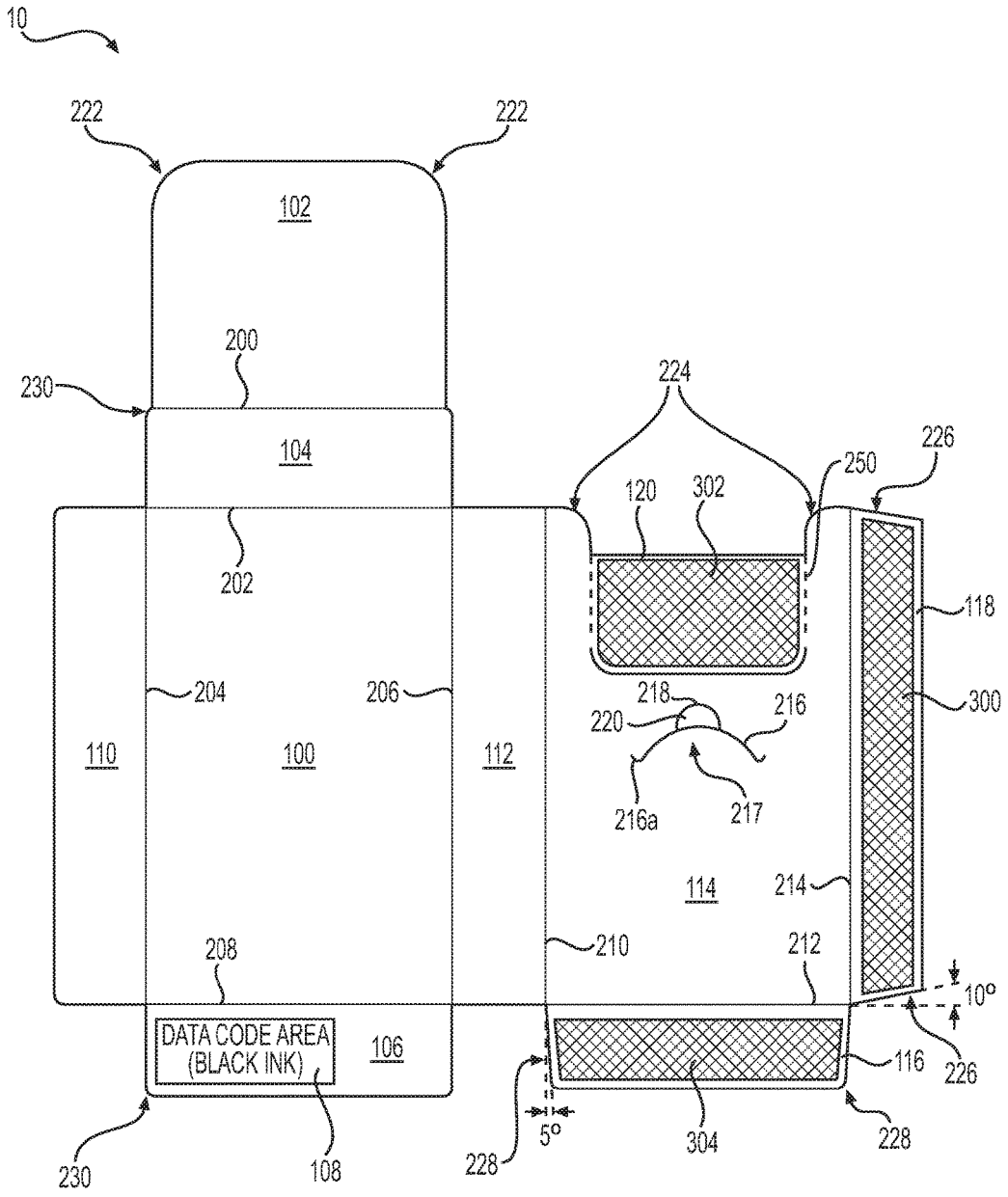
FIG. 1 is an illustration of a blank for making a pack, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, items, regions, layers and/or sections, these elements, items, regions, layers, and/or sections should riot be limited by these terms. These terms are only used to distinguish one element, item, region, layer, or section from another region, layer, or section. Thus, a first element, item, region, layer, or section discussed below could be termed a second element, item, region, layer, or section without departing from the teachings of example embodiments.

Spatially relative terms "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or items, but do not preclude the presence or addition of one or more other features, integers, steps, operations, elements, items, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should he interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value includes a tolerance of ±10% around the stated numerical value (or range of values). Moreover, when reference is made to percentages in this specification, it is intended that those percentages are based on weight (i.e., weight percentages). The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. When used with geometrice s, the words "generally" and "substantially" are intended to encompass not only features which meet the strict definitions but also features which fairly approximate the strict definitions.

FIG. 1 is an illustration of a blank 10 for making a pack, in accordance with an example embodiment. The blank 10 may be formed from two major portions that may include a front panel 100 and a back panel 114. The front panel 100 may include a top panel 104, where a first fold line 202 may divide the front panel 100 from the top panel 104. The front panel 100 may also include a tuck panel 102, where a second fold line 200 may divide the tuck panel 102 from the top panel 104. A side panel 110 may run vertically along a side of the front panel 100, where a third fold line 204 may divide the side panel 110 from the front panel 100.

A lower panel 106 may he connected to a lower portion of the front panel 100, where a fourth fold line 208 may divide the lower panel 106 from the front panel 100. The lower panel 106 may include an upper surface that may include a date code area 108 that may indicate date information related to the shelf life of a product that may be contained in a pack made from the blank 10.

An intermediate panel 112 may separate the front panel 100 from the back panel 114. A fifth fold line 206 may divide the front panel 100 from the intermediate panel 112, and a sixth fold line 210 may divide the back panel 114 from the intermediate panel 112.

The back panel 114 may include an upper surface that may include an upper portion 120 that may be a varnish free area 302 which may be circumscribed by a perforated line 250. As described herein in more detail, the perforated line 250 may provide an assembled pack 12 with a tear open feature (see the discussion of FIGS. 5 and 8, in particular).

The back panel 114 may also include a side glue panel 118 running along a vertical side of the panel 114. The side glue panel 118 may include an upper surface that may be a side varnish free area 300. A seventh fold line 214 may divide the back panel 114 from the side glue panel 118.

The back panel 114 may include a lower glue panel 116 running along a lower portion of the back panel 114. The lower glue panel 116 may include an upper surface that may be a lower varnish free area 304. An eighth fold line 212 may divide the lower glue panel 116 from the back panel 114.

A slit 216 may be included in the back panel 114. The slit 216 may be in the shape of a partial-ellipse. Ends of the slit 216 may include an upward-directed curvature 216*a*. The slit 216, and the upward-directed curvatures 216*a* on the end of the slit 216, may allow a re-closeable flap 217 to be pulled away from a front surface of the back panel 114 in order to facilitate easy opening and re-closing of the pack 12 (as described in more detail herein). A half-moon slit 218 may form an aperture 220 in a center-location above the re-closeable flap 217. Specifically, the aperture 220 may be a cut-out area of the back panel 114 that may assist in the use of the flap 217.

The blank 10 may he formed from a single web of material. The material or materials used to make the blank 10 may include cardboard, paperboard, plastic, metal, or combinations thereof. In an embodiment, the blank 10 may be formed by more than one layer of one or more of these materials. In an embodiment, the blank 10 may be formed from cardboard having a weight ranging from about 100 grams per square meter to about 350 grams per square meter.

An upper surface of the blank 10 may be a clay (printable) side of the blank 10, where it should be understood that the upper surface of the blank 10 is shown in FIG. 1. The blank 10, or at least the upper surface of the blank 10, may include a finish, or "varnish." In an embodiment, the upper surface of the blank 10 may also include embossing, debossing, embellishments, and combinations thereof, as the upper surface of the blank 10 may form an outer surface of a fully assembled pack 12. In an embodiment, at least a portion of at least one of the lower varnish free area 304 of the lower glue panel 116, the side varnish free area 300 of the side glue panel 118, and the upper varnish free area 302 of the upper portion 120 of the front panel 114, may be "varnish free." These "varnish free" areas may be devoid of any printing or varnish. In an embodiment, the date code area 108 may also be a varnish free area of the upper surface of the lower panel 106 of the blank 10. In an embodiment, an entire rear surface of the blank 10 may also be a varnish free area. It should be understood that these "varnish free" areas may improve any bonding formed by glue, an adhesive (such as a hot-melt adhesive material), and/or tape (such as a pressure sensitive tape).

Dimensional Information:

Dimensions of the blank 10 may vary, depending for instance on a size of a consumable product that may be stored within a pack 12 that may be formed by the blank 10. In an embodiment, a width and a height of the front panel 100 and the back panel 114 may be the same, where this width may be about 55 mm and the height may be about 90 mm. A width of the upper varnish free area 302 that may be circumscribed by the perforated line 250 may be about 22 mm, with a length of the upper varnish area being about 39 mm. A width of the side panel 110 may be somewhat smaller than a width of the intermediate panel 112, with a width of the side panel 110 being between about 13.25 mm and 19.25 mm (such as 13.25 mm, 16.25 mm or 19.25 mm), and width of the intermediate panel 112 being between about 14 mm and 20 mm (such as 14 mm, 17 mm or 20 mm). A height of the top panel 104 may be between about 14.5 mm and 20.5 mm (such as 14.5 mm, 17.5 mm and 20.5 mm). A height of the tuck panel 102 may be about 45 mm. A width of the side glue panel 118 may be about 12.75 mm, and a width of the lower glue panel 116 may be about 12 mm to 15 mm. A width of the lower panel 106 may be between about 13 mm and 19 mm. A width of the date code area 108 may be about 10 mm and a length of the date code area 108 may be about 26 mm. A total height of the blank 10 may be between about 162.5 mm and 174.5 mm (such as 162.5 mm, 168.5 mm or 174.5 mm), and a total height of the blank 10 may be between about 150 mm and 162 mm (such as 150 mm, 1.56 mm and 162 mm).

In an embodiment, the blank 10 may include a number of rounded corners. For instance, corners 230 of the lower panel, the side panel 110, and upper corners of the top panel 104 may have small rounded corners, where a radius of the curvature of these corners 230 may be about 1 mm. Upper corners 222 of the tuck panel 102 may have larger rounded corners, where a radius of the curvature of these corners 222 may be about 10 mm. Upper corners 224 of the back panel 114 may have a radius of curvature of about 5 mm.

In an embodiment, the half-moon slit 218 may have a radius of curvature of about 4 mm. The slit 216 in the back panel 114 may have a radius of curvature of about 11.5 mm, and the upward-directed curvature of the slit 216 may have a radius of curvature of about 1.5 mm.

The side glue panel 118 may have ends that include angled edges 226, where the edges 226 may be angled at about 10 degrees. The ends of the lower glue panel 116 may also have angled edges 228, where the edge 228 may be angled at about 5 degrees.

Figure 2:
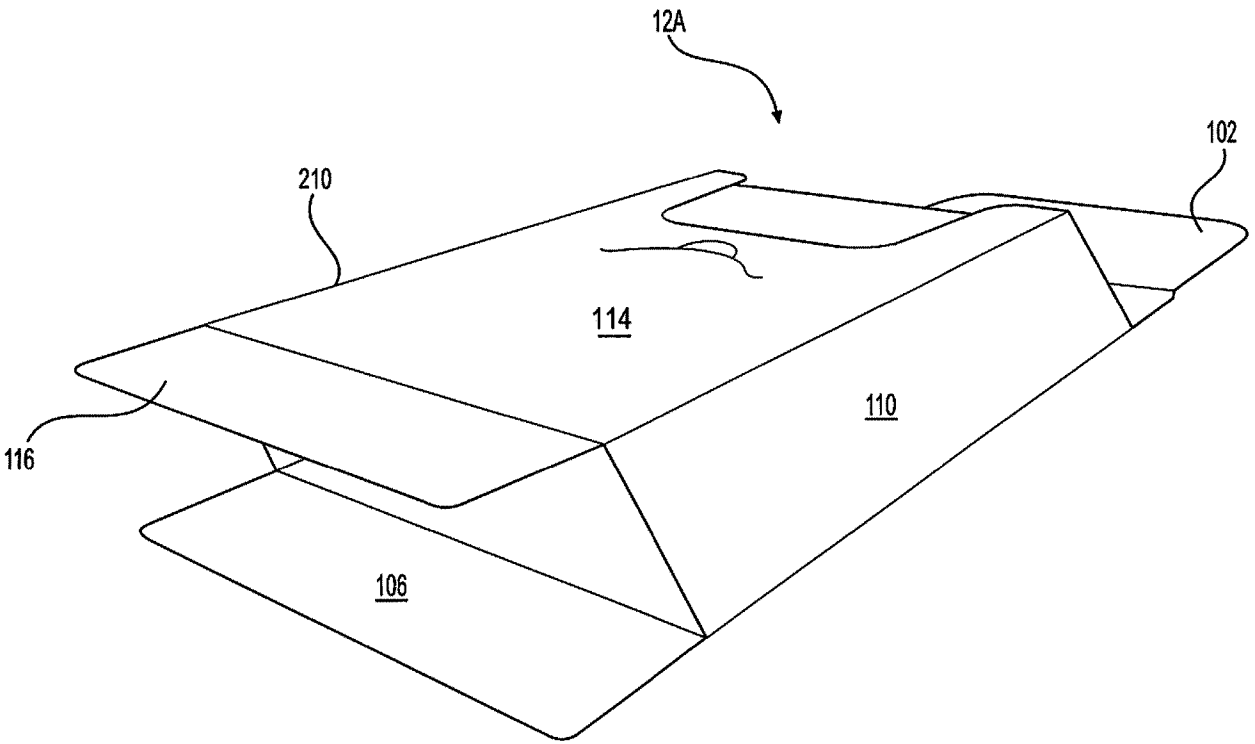
FIG. 2 is an illustration of a partially formed pack made from the blank, in accordance with an example embodiment.

FIG. 2 is an illustration of a partially formed pack 12 made from the blank 10 (of FIG. 1), in accordance with an example embodiment. In particular, FIG. 2 depicts the blank 10 in a four-sided "sleeve" configuration 12*a*, prior to the ends of the sleeve 12*a* being sealed closed to form the pack 12 (i.e., a box structure). It is noted that in this configuration, the side panel 110 may be folded over and connected to an upper surface of the side glue panel 118, via an adhesive, in order to form the "sleeve." From this configuration, the lower glue panel 116 may he folded downward, allowing the lower panel 106 to be folded upward to seal a bottom end of the sleeve 12*a*, in order to form the pack 12 (see FIG. 7). And, the tuck panel 102 may be folded up and over an upper portion of the back panel 114 to seal an upper end of the sleeve 12*a*, in. order to seal the pack 12 prior to vending of the pack 12.

Figure 3:
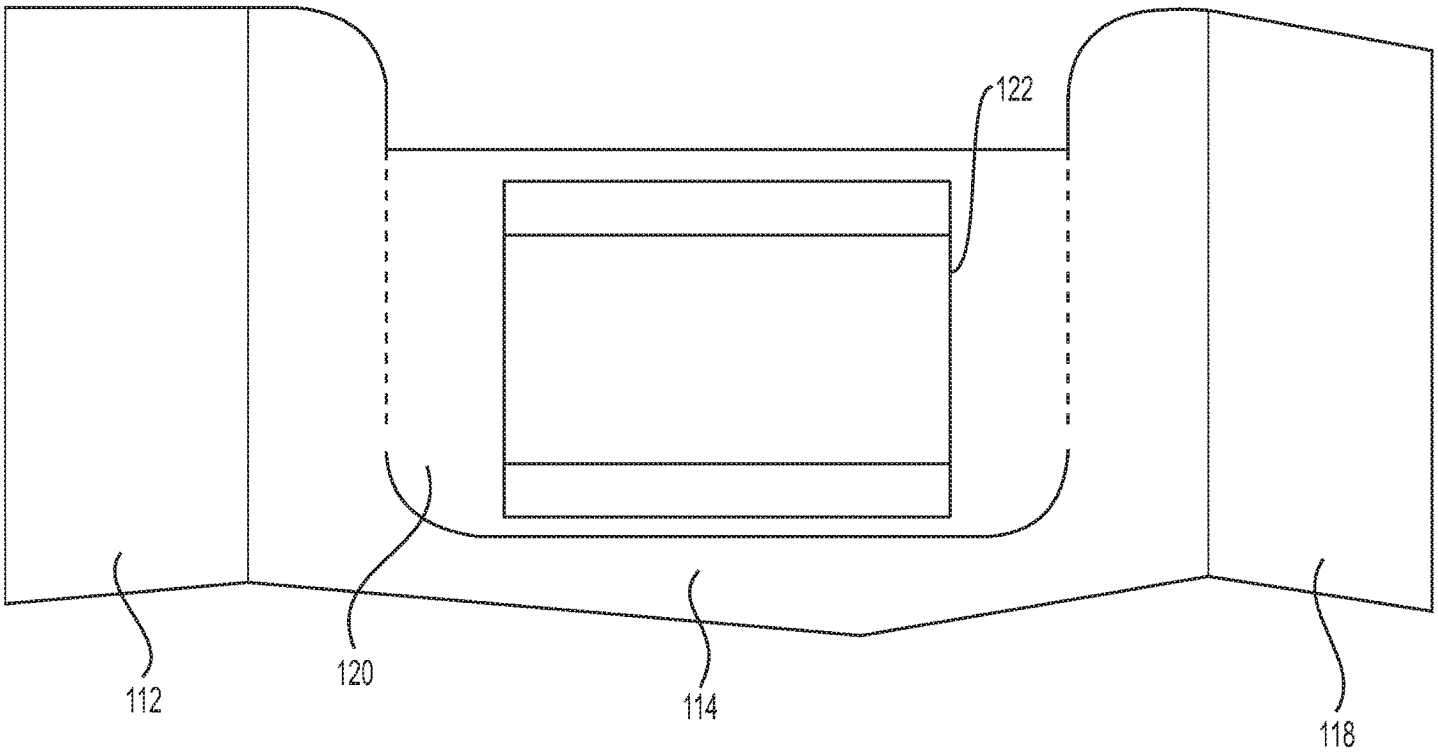
FIG. 3 is an illustration of a top portion of a back panel of the blank, in accordance with an example embodiment.
Figure 8:
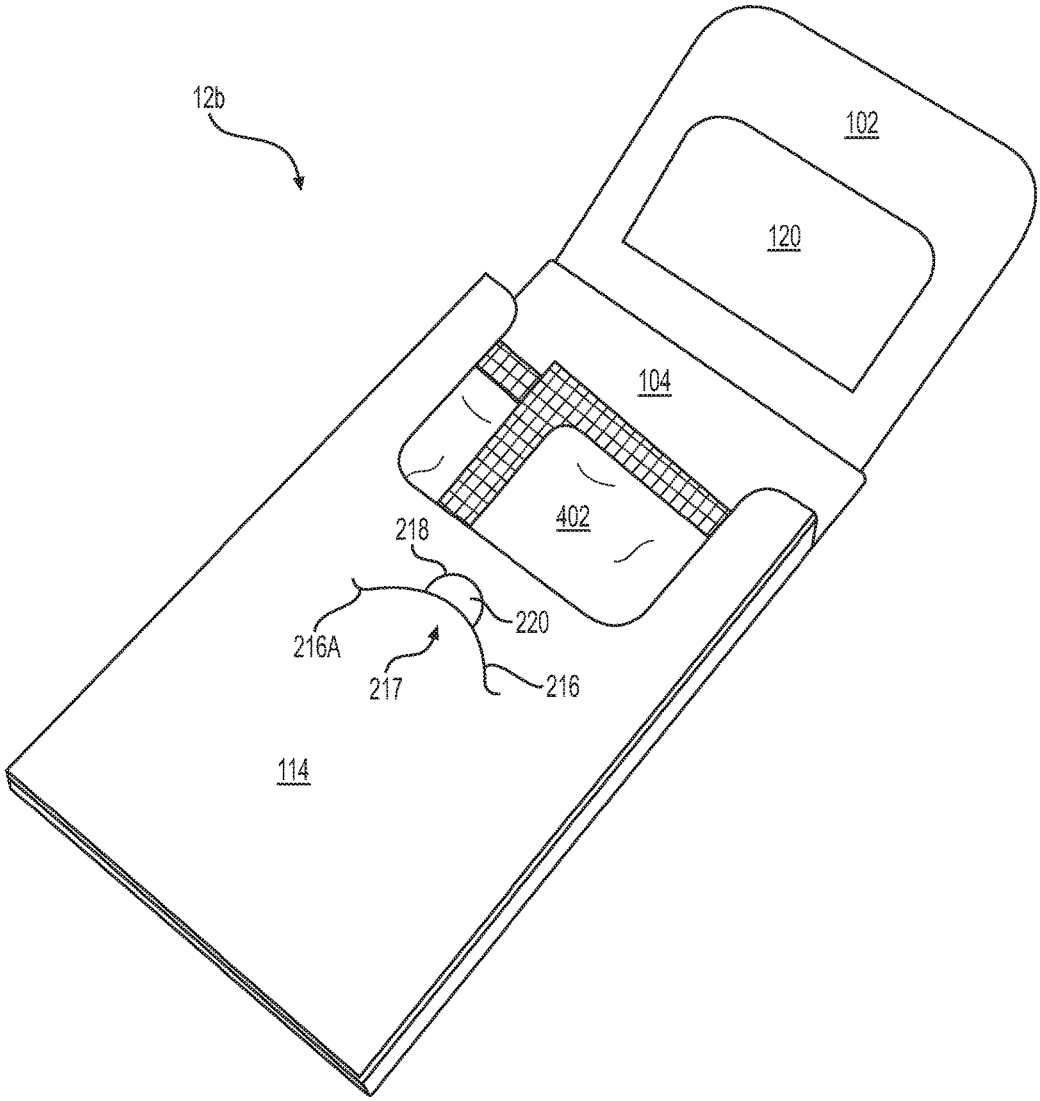
FIG. 8 is an illustration of a pack containing consumable items, in accordance with an example embodiment.

FIG. 3 is an illustration of a top portion of a back panel 114 of the blank 10, in accordance with an example embodiment. In an embodiment, glue, an adhesive (such as a hot-melt adhesive), and/or a tape (such as a pressure sensitive tape) 122 may be applied to the upper portion 120 in the varnish free area 302. The adhesive and/or tape 122 may be used to fasten the upper portion 120 of the back panel 114 to a back surface of the tuck panel 102 in order to seal the sleeve 12*a* to close the pack 12. In doing so, a subsequent "opening" of the top end of the sealed pack 12 may cause the upper portion 120 of the back panel 114 to remain connected to the tuck panel 102, as the upper portion 120 may "tear away" from the back panel 114 via the perforated line 250 (see FIG. 8 depicting the "opened" pack 12 with the upper portion 120 connected to the tuck panel 102). It should be understood that this "tear away" feature of the upper portion 120 may provide an indication of tampering of the pack 12, prior to or in conjunction with vending of the pack 12.

Figure 4:
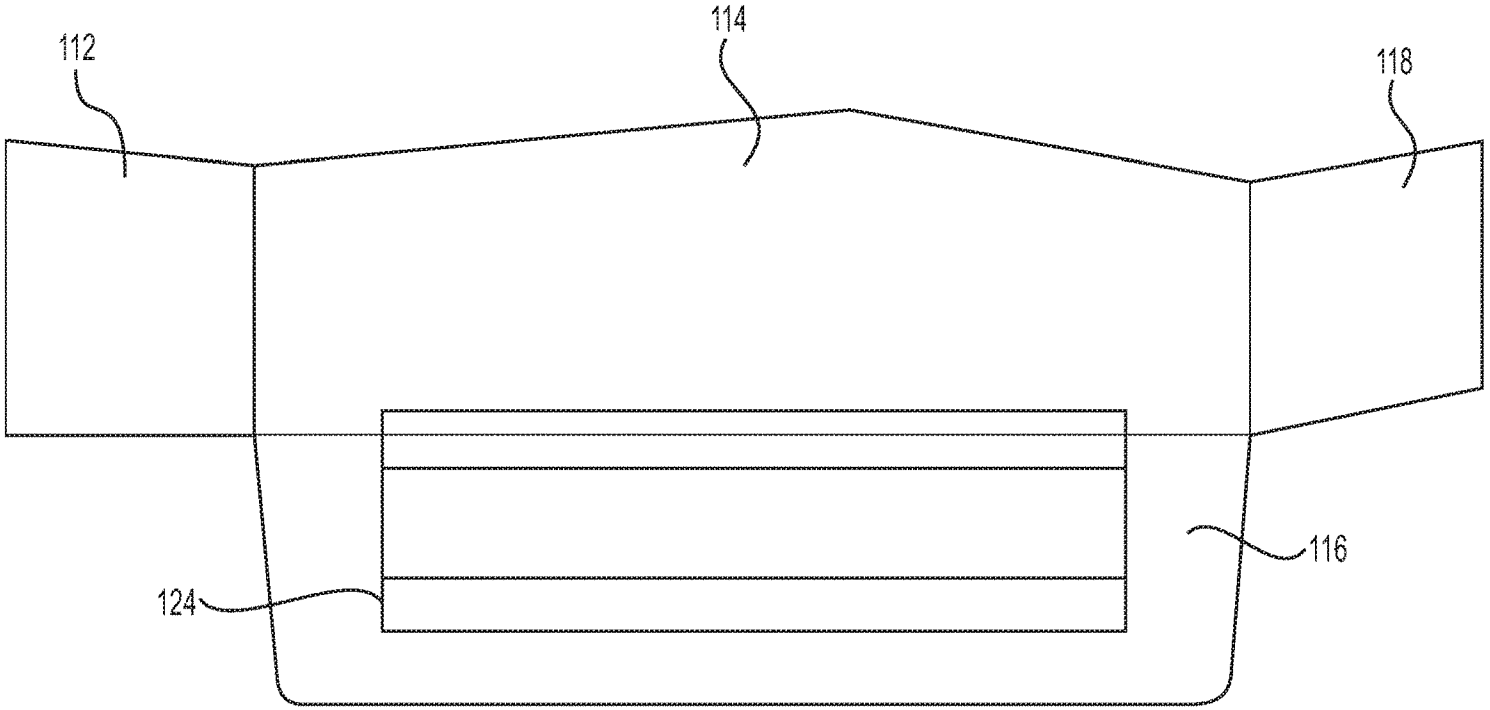
FIG. 4 is an illustration of a lower portion of the back panel of the blank, in accordance with an example embodiment.

FIG. 4 is an illustration of a lower portion of the back panel 114 of the blank, in accordance with an example embodiment. In an embodiment, glue, and adhesive (such as a hot-melt adhesive) and/or a tape (such as a pressure sensitive tape) 124 may be applied to an upper surface of the lower glue panel 116. This adhesive and/or tape 124 may be used to seal the upper surface of the lower glue panel 116 to a lower surface of the of the lower panel 106 in order to seal a lower end of the sleeve 12*a* in order to assist in forming an assembled and sealed pack 12.

Figure 5:
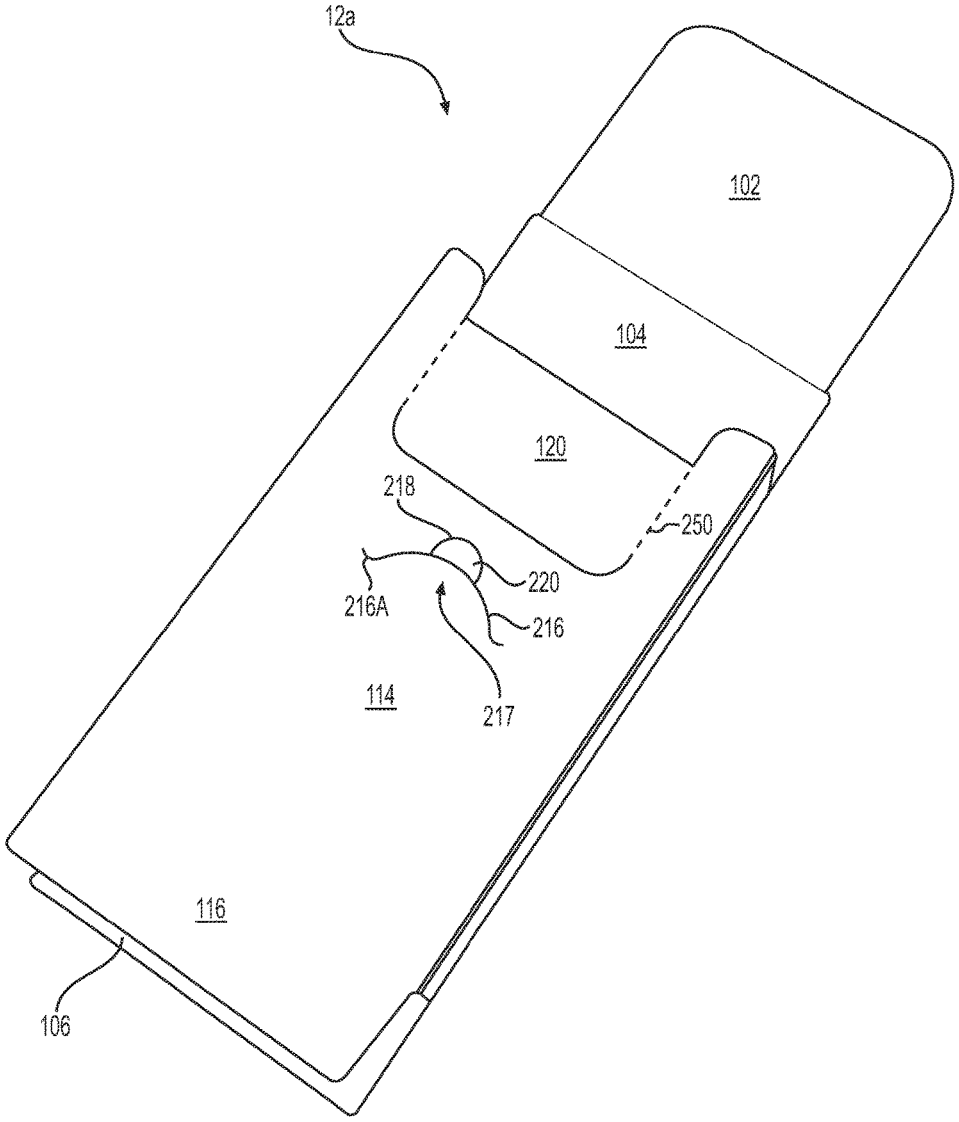
FIG. 5 is an illustration of a partially formed pack, in accordance with an example embodiment.

FIG. 5 is an illustration of a partially formed pack that is in the "sleeve" 12*a* configuration (i.e., both ends are unsealed), in accordance with an example embodiment. In this configuration, the upper portion 120 of the back panel 114 remains attached to the back panel 114, prior to a rear surface of the tuck panel 102 being connected to the upper portion 120 by the adhesive and/or tape 124. The lower end of the sleeve 12*a* is also shown as being unsealed, as an upper surface of the lower glue panel 116 has not yet been connected to a rear surface of the lower panel 106. Once the top and bottoms ends of the sleeve 12*a* are sealed, the pack 12 may be fully assembled by sealing upper and lower ends of the sleeve 12*a*, as described herein.

Figure 6:
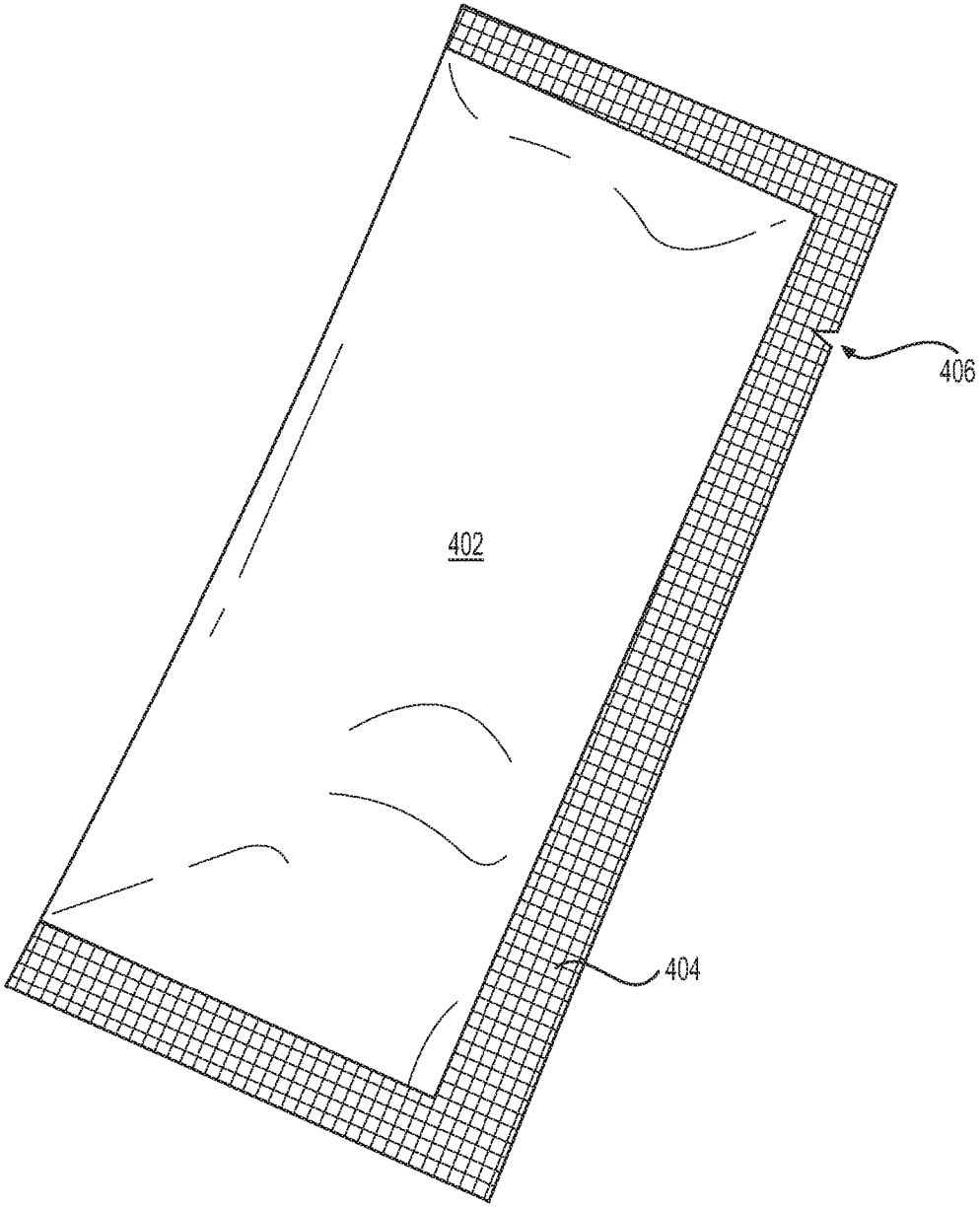
FIG. 6 is an illustration of a consumable item that may be stored in a pack, in accordance with an example embodiment.

FIG. 6 is an illustration of a consumable item 402 that may be stored in a pack 12, in accordance with an example embodiment. In an embodiment, the consumable item 402 may be a pouch structure containing a consumable. The consumable material (not shown) may, for instance, be an element of an e-vaping device, such as a cartridge of an e-vapirig device. The consumable material may also contain a pre-vapor formulation for an e-vaping device, where the pre-vapor formulation may degrade, to at least some degree, due to an exposure to environmental factors. The pouch 402 may be made from an appropriate foil material, such as aluminum foil, tin foil, or other such material that may protect the consumable from potential degradation due to environmental factors. The pouch 402 may be sealed or crimped 404 on an end or ends. A slit 406 may be included at a location in the crimp 404, in order to facilitate a quick and convenient opening of the pouch 402.

Figure 7:
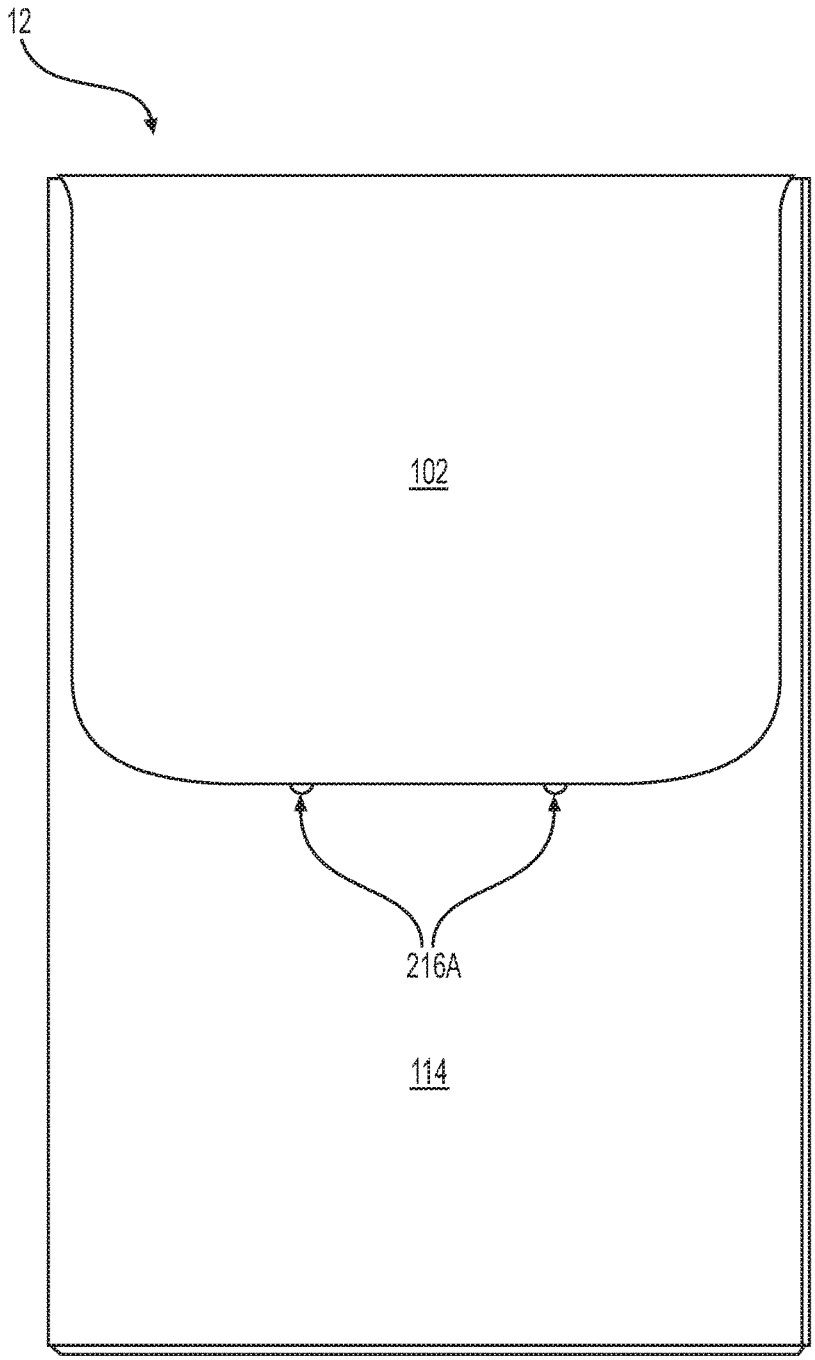
FIG. 7 is an illustration of a fully assembled and sealed pack, in accordance with an example embodiment.

FIG. 7 is an illustration of a fully assembled and sealed pack 12, in accordance with an example embodiment. In this "sealed" configuration, the front surface of the lower glue panel 116 is connected to a rear surface of the lower panel 106, via an adhesive, in order to seal a bottom end of the pack 12. A front surface of the upper portion 120 is also connected to a rear surface of the tuck panel 102, via an adhesive, in order to seal a top end of the pack 12. Notice that a distal end of the tuck panel 102 is positioned near the upward-directed curvatures 216*a* at an end of slit 216 (shown in FIGS. 5 and 8), in this "sealed" configuration.

FIG. 8 is an illustration of an "opened" pack 12*b* containing one or more consumable items 402, in accordance with an example embodiment. Notice that, in this configuration, an upper end of the pack 12*b* has been opened, causing the upper portion 120 to be "torn away" from the back panel 114. The slit 216 allows the flap 217 to be pulled apart from the back panel 114, so that the upper end of the pack 12*b* may he re-closed by tucking a distal end of the tuck panel 102 into the slit 216. The aperture 218 above the slit 216 may assist in allowing a top portion of the flap 217 to be slightly pulled away from the back panel 114 during a re--opening or a re-closing of the top end of the pack 12*b*.

When the "opened" pack 12*b* is re-closed (see FIG. 9), outer edges of the upper portion 120 may mate with edges of the back panel 114, along the interface between the upper portion 120 and the back panel 114 that had been defined by the perforated line 250, in order to stabilize a position of the tuck panel 102 on the back panel 114 once the distal end of the tuck panel 102 is retained by the slit 216. That is to say, by mating the edges of the upper portion 120 with the edges of the back panel 114, the tuck panel 102 may, to some degree, resist a sliding motion along the upper surface of the back panel 114, especially once the end of the tuck panel 102 is fitted into the slit 216. The mating of the edges of the upper portion 120 and the back panel 114 may also help guide (i.e., center) the tuck panel 102 relative to the back panel 114, as the end of the tuck panel 102 is fitted into the slit 216.

Figure 9:
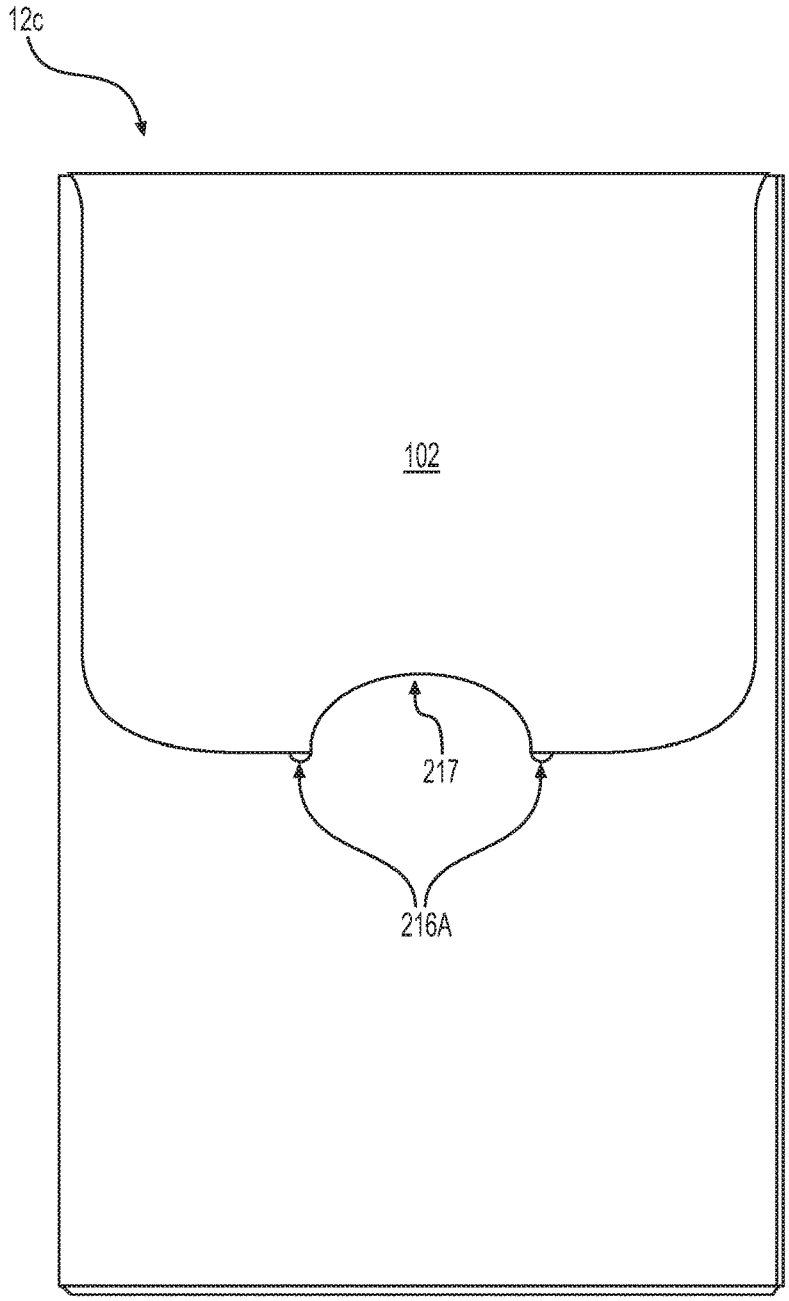
FIG. 9 is an illustration of a re-closed pack, in accordance with an example embodiment.

FIG. 9 is an illustration of a re-closed pack 12*c*, in accordance with an example embodiment. In this configuration, a distal end of the tuck panel 102 may be fitted into slit 216, thereby allowing the re-closeable flap 217 to pin the distal end of the tuck panel 102 against the back panel 114. The distal end of the tuck panel 102 also is held more firmly in place, within slit 216, by the two upward-directed curvatures 216*a* of the slit 216.

Figure 10:
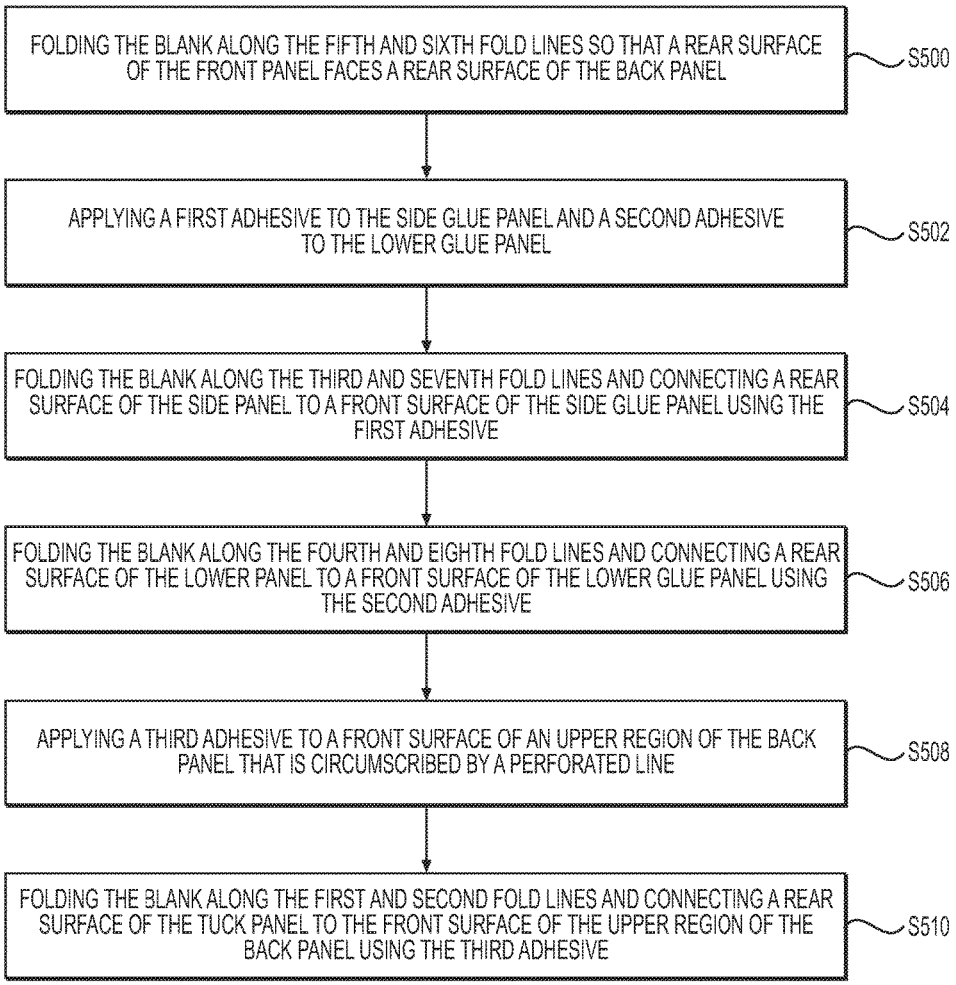
FIG. 10 is a flowchart of a method of forming a pack from a blank, in accordance with an example embodiment.

FIG. 10 is a flowchart of a method of forming a pack 12 from a blank 10, in accordance with an example embodiment. In step S500 of the method, the blank 10 may be folded along the fifth fold line 206 and the sixth fold line 210 so that a back surface of the front panel 100 and a back surface of the back panel 114 face each other.

In step S502, a first adhesive and/or pressure sensitive tape may be applied to the side glue panel 118, and a second adhesive and/or pressure sensitive tape may be applied to the lower glue panel 116. In step S504, the blank 10 may be folded along the third fold line 204 and the seventh fold line 214, whereupon the rear surface of the side panel 110 and a front surface of the side glue panel 118 may be connected using the first adhesive and/or tape, thereby forming a four-sided "sleeve" 12*a* (with top and bottom ends left unsealed).

In step S506, the blank 10 may be folded along the fourth fold line 208 and the eighth fold line 212 in order to connect a rear surface of the lower panel 106 to a front surface of the lower glue panel 116 using the second adhesive and/or tape, in order to seal a bottom end of the sleeve 12*a*. The first and second adhesives may be a same adhesive (or tape), or the adhesives may be different from each other.

In step S508, a third adhesive and/or pressure sensitive tape may be applied to a front surface of an upper portion 120 of the back panel 114, where the upper portion 120 is circumscribed by a perforated line 250. The third adhesive (or tape) may he a same adhesive as the first and second adhesives (described above), or the adhesive may be a different adhesive. In step S510, the blank 10 may be folded along the first fold line 202 and the second fold line 200 so that a rear surface of the tuck panel 102 may be connected to the front surface of the upper portion 120 of the back panel 114 using the third adhesive and/or tape, thereby forming a six-sided sealed "pack" 12. This may allow the pack 12 to be configured to cause the upper portion 120 of the back panel 114 to stay connected to the tuck panel 102, so that the upper portion may be "torn away" from the back panel 114, as the assembled pack 12 is initially opened.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A pack, comprising:

a box structure defining an inner cavity, the box structure including, a front panel and a back panel, a first side formed by an intermediate panel that is connected to the front panel and the back panel, a second side that is sealed by a first adhesive, the first adhesive connecting a rear surface of a side panel that is connected to the front panel to a front surface of a side glue panel that is connected the back panel, a lower end that is sealed by a second adhesive, the second adhesive connecting a rear surface of a lower panel that is connected to the front panel to a front surface of a lower glue panel that is connected to the back panel, and an upper end that is sealed by a third adhesive, the third adhesive connecting a rear surface of a tuck panel to a front surface of an upper portion of the back panel, the tuck panel being connected to a top panel that is connected to the front panel, and the upper portion being at least partially circumscribed by a perforated line that is configured to cause the upper portion of the back panel to stay connected to the tuck panel and tear away from a remaining portion of the back panel if the upper end of the box structure is opened.

2. The pack of claim 1, wherein the back panel defines a slit between the upper end and the lower end of the box structure, the slit being positioned to retain a distal end of the tuck panel in order to re-close the upper end of the box structure after the upper end of the box structure has been opened.

3. The pack of claim 1, wherein an outer edges of the upper portion is configured to mate with an edge of the remaining portion of the back panel after the upper end of the box structure has been opened and the upper end of the box structure is re-closed.

4. The pack of claim 1, wherein the box structure is made from a blank, the blank being a single web of material.

5. The pack of claim 4, wherein at least a portion of the front surface of the upper portion of the back panel, at least a portion of the front surface of the side glue panel, and at least a portion of the front surface of the lower glue panel are vanish free areas.

6. The pack of claim 1, wherein the inner cavity of the pack contains one or more pouches of consumable material, the pack having a length of about 90 mm, a width of about 55 mm and a depth of between about 14 mm and 20 mm.

7. The pack of claim 1, wherein one or more of the adhesives include a pressure sensitive tape.

8. A blank for forming a pack, comprising:

a single web of material including, a front panel connected to a back panel via an intermediate panel, a top panel connected to a top portion of the front panel along a first fold line, a tuck panel connected to a top portion of the top panel along a second fold line, a side panel connected to a first side of the front panel along a third fold line, a lower panel connected to a lower portion of the front panel along a fourth fold line, the intermediate panel connected to a second side of the front panel along a fifth fold line, the intermediate panel connected to a first side of the back panel along a sixth fold line, a side glue panel connected to a second side of the back panel along a seventh fold line, a lower glue panel connected to a lower portion of the back panel along an eighth fold line, and an upper portion of the back panel being at least partially circumscribed by a perforated line.

9. The blank of claim 8, wherein the upper portion of the back panel is configured to tear away from a remaining portion of the back panel if a rear surface of the tuck panel is connected to a front surface of the upper portion by a first adhesive when the blank is formed into the pack, and the tuck panel is then subsequently separated from remaining portion of the back panel when the pack is first opened.

10. The blank of claim 8, wherein a rear surface of the blank, at least a portion of a front surface of the upper portion of the back panel, at least a portion of a front surface of the side glue panel, and at least a portion of a front surface of the lower glue panel are vanish free areas.

11. The blank of claim 8, wherein an overall width of the blank is between about 150 mm and 162 mm, an overall height of the blank is about 162.5 mm and 174.5 mm, a width of the front panel and back panel is about 55 mm, a height of the front panel and back panel is about 90 mm, and a width of the intermediate panel is between about 14 mm and 20 mm.

12. The blank of claim 8, wherein ends of the side glue panel include angled edges that are angled at about 10 degrees relative to the first and eighth fold lines, respectively, and ends of the lower glue panel include angled edges that are angled at about 5 degrees relative to the sixth and seventh fold lines, respectively.

13. A pack made from the blank of claim 8, the pack including a box structure defining an inner cavity, wherein the box structure includes, the front panel, the back panel, a first side formed by the intermediate panel, a second side formed via a first adhesive connecting a rear surface of the side panel connected to the front panel to a front surface of the side glue panel connected the back panel, a lower end that is formed via a second adhesive connecting a rear surface of the lower panel connected to the front panel to a front surface of the lower glue panel connected to the back panel, and an upper end that is formed via a third adhesive connecting a rear surface of the tuck panel to a front surface of the upper portion of the back panel, the perforated line being configured to cause the upper portion of the back panel to stay connected to the tuck panel and tear away from a remaining portion of the back panel if the upper end of the box structure is opened.

14. The pack of claim 13, wherein the inner cavity of the pack contains one or more pouches of consumable material, the pack having a length of about 90 mm, a width of about 55 mm and a depth of between about 14 mm and 20 mm.

15. The pack of claim 13, wherein one or more of the adhesives include a pressure sensitive tape.

* * * * *